United States Patent [19]

Oppenlaender et al.

[11] Patent Number: 5,071,445

[45] Date of Patent: Dec. 10, 1991

[54] REACTION PRODUCTS OF AMINOALKYLENE POLYCARBOXYLIC ACIDS WITH SECONDARY AMINES AND MIDDLE DISTILLATE COMPOSITIONS CONTAINING THE AFORESAID

[75] Inventors: Knut Oppenlaender, Ludwigshafen; Brigitte Wegner, Speyer; Klaus Barthold, Manheim; Erich Schwartz, Ludwigshafen; Egon Buettner; Manfred Schramm, both of Viernheim, all of Fed. Rep. of Germany

[73] Assignee: BASF Aktiengesellschaft, Rheinland-Pfaiz, Fed. Rep. of Germany

[21] Appl. No.: 525,945

[22] Filed: May 18, 1990

[51] Int. Cl.[5] ..... C10L 1/22

[52] U.S. Cl. ..... 44/408; 44/418; 44/419

[58] Field of Search ..... 44/419, 418, 408; 564/153

[56] References Cited

U.S. PATENT DOCUMENTS

| | | | |
|---|---|---|---|
| 3,024,277 | 3/1959 | Hotten | 564/153 |
| 3,168,415 | 2/1965 | Goldstein et al. | 564/153 |
| 3,173,770 | 3/1965 | Thompson et al. | 44/419 |
| 3,202,491 | 8/1965 | Maxwell et al. | 44/419 |
| 3,407,051 | 10/1968 | Thompson et al. | 44/419 |
| 3,645,953 | 2/1972 | Hindersinn et al. | 564/153 |
| 4,249,912 | 2/1981 | Holtz et al. | 44/419 |

*Primary Examiner*—Prince E. Willis
*Assistant Examiner*—Jerry D. Johnson

[57] ABSTRACT

Novel reaction products of aminoalkylene polycarboxylic acids with secondary amines and their use as additives to middle distillates together with conventional ethylene copolymers as flow improvers and conductivity improves.

5 Claims, No Drawings

REACTION PRODUCTS OF AMINOALKYLENE POLYCARBOXYLIC ACIDS WITH SECONDARY AMINES AND MIDDLE DISTILLATE COMPOSITIONS CONTAINING THE AFORESAID

BACKGROUND OF THE INVENTION

The present invention deals with novel reaction products of aminoalkylene carboxylic acids with secondary long chain amines as well as middle distillates containing these reaction products, which have an improved low temperature flowability and are able to better disperse precipitated paraffin crystals.

Middle distillates such as, for example, gas oils, diesel oils, or heating oils, which are derived from the distillation of petroleum oils, contain different amounts of paraffins depending on the source of the crude oil. At lower temperatures solid paraffins settle out (cloud point, CP). When further cooled, the plate shaped n-paraffin crystals form a "card-house structure" and the middle distillate congeals, although the majority of the middle distillate is still liquid. The flowability of the petroleum oil distillate fuel and/or fuel is substantially impaired by the precipitated n-paraffins in the temperature range between the cloud point and pour point. The paraffin plugs up filters and causes non-uniform or completely interrupted fuel feed to the combustion units. Similar problems occur with heating oils.

FIELD OF THE INVENTION

It has long been known to modify the crystal growth of paraffins in petroleum oil distillate fuel and fuels by suitable additives. Effective additives on one hand prevent the middle distillates from forming such card-house structures, and they prevent solidification at temperatures several degrees Celsius below the temperature at which the first paraffin crystals settle out. Furthermore they form, fine, well crystallized, separate paraffin crystals which pass through filters in motor vehicles and heating units or at least form a filter cake permeable for the liquid portion of the middle distillates so that problem-free operation is ensured.

A disadvantage of the aforesaid state-of-the-art is that the paraffin crystals settle out, due to their higher density compared to the liquid portion, and tend to accumulate on the bottom of the tank when stored. In turn, a homogeneous paraffin-free-phase forms in the upper portion of the tank and on the bottom of the tank a duel phase paraffin-rich-layer forms. Since both in fuel tanks as well as in storage or delivery tanks of the mineral oil dealer, the middle distillate is more often than not withdrawn just above the tank floor, there is the danger that the high concentration of solid paraffins will lead to the plugging up of filters and metering equipment. This danger increases all the more as the storage temperature goes below the precipitation temperature of the paraffin (cloud point) since the amount of separated paraffin is represents a function of temperature and increases with decreasing temperature.

Paraffin crystal modifiers, the so called flow improvers, are polymers which alter the crystal growth of n-paraffins by co-crystallization (interaction). Thus the flow properties of a middle distillate are positively influenced at lower temperatures. The effectiveness of the flow improver is expressed indirectly by measuring the "Cold Filters Plugging Points" (CFPP) according to DIN 51428.

DESCRIPTION OF THE RELATED ART

Low temperature flow improvers are conventional ethylene copolymers, especially copolymers of ethylene and unsaturated esters. DE 11 47 799 and 19 14 756 disclose, for example, copolymers of ethylene with vinyl acetate comprising from 25 to 45 weight percent of vinyl acetate or vinyl propionate having a molecular weight of from 500 to 5,000.

GB 2 095 698 also discloses adding a combination of the aforesaid copolymers with amides of long chain amines and aromatic and cycloaliphatic carboxylic acids to the middle distillates.

However, these mixtures are unsatisfactory with respect to the dispersing properties of the paraffins settled out.

The object of the present invention, therefore, is to present additives to middle distillates which would have an improved paraffin dispersing effect with good flow improvement.

This object is met as a result of the reaction product of amides, amide ammonium salts, ammonium salts and mixtures thereof and aminoalkylene polycarboxylic acids which yield compounds having the following general structural formulas I and II

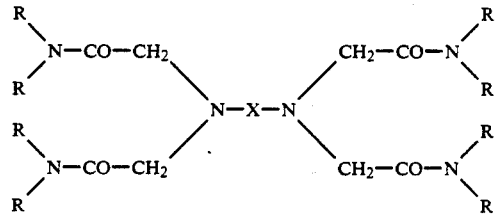

I

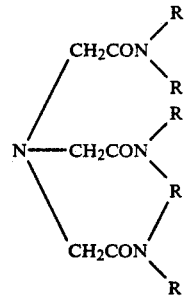

II in which;

X is a straight chain or branched alkylene radical having 2 to 6 carbon atoms or is the following radical

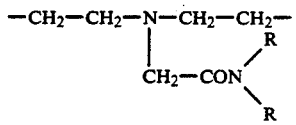

in which R is an essentially straight chain aliphatic radical, preferably an alkyl radical having 10 to 30, more preferably 14 to 24 carbon atoms whereby the amide structures can be present partially or completely in the form of the ammonium salt structure having the following structural formula:

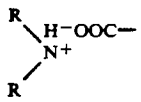

The amide and/or amide ammonium salts and/or ammonium salts, for example, of nitrilotriacetic acid, of ethylene diamine tetraacetic acid or 1,2-propylene diamine tetra-acetic acid are obtained by reacting the acids with from 0.5 to 1.5 moles of amine, more preferably 0.8 to 1.2 moles amine per carboxyl group.

The reaction temperatures are from about 80° to 200° C. whereby when preparing the amides the water resulting from the reaction is continuously removed. The reaction need not be carried out completely to the amide, and moreover from 0 to 100 mole percent of the amine used can be present in the form of the ammonium salt.

Amines having the following general structural formula

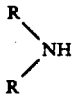

are most preferably dialkyl amines in which R is a straight chain radical having 10 to 30 carbon atoms, more preferably 14 to 24 carbon atoms. Individual examples are dioleyl amine, dipalmitin amine, di-coconut fatty amine, and dibehenyl amine and, more preferably ditallow fatty amine.

DESCRIPTION OF PREFERRED EMBODIMENTS

The novel amides and/or ammonium salts of aminoalkylene polycarboxylic acids having general structural formulas I and II are added to the petroleum middle distillate in quantities of from 50 to 1,000 ppm, more preferably 100 to 500 ppm. Generally, the middle distillates already contain ethylene vinyl ester copolymers, especially ethylene vinyl acetate copolymers as described in, for example, DE 19 14 756.

According to a preferred embodiment, the petroleum middle distillate compositions contain small amounts of components of the following additive combination:

a) 50 to 1,000 ppm, more preferably 100 to 500 ppm of aminoalkylene polycarboxylic acid derivatives having general structural formulas I and/or II;

b) conventional ethylene copolymers flow improves, for example, ethylene vinyl ester copolymers in quantities of from 50 to 1,000 ppm, more preferably 50 to 500; and c) conductivity improvers in the form of salts, especially carboxylic acids and sulfonic acids and/or their metal salts and ammonium salts in quantities of from 0.25 to 40 ppm, more preferably 1.5 to 20 ppm.

The conventional flow improvers (b) are thoroughly described in the patent literature. Examples are Federal Republic of Germany 19 14 756, EP 214786 (a-olefin/-MSA-ester) and EP 155807 (alkyl fumarate/VAC-copolymers) which are hereby incorporated by reference. However, likewise terpolymers are also examples which, along with ethylene and vinyl esters or acrylic esters contain other comonomers polymerized in situ.

Preferred copolymers (b) are those comprising essentially ethylene and from 25 to 45 weight percent of vinyl acetate, vinyl propionate, or ethylhexyl acrylate. In addition, there are copolymers which contain, for example, fumaric acid ester. The molecular weight of the flow improver generally is from 500 to 5,000, more preferably 1,000 to 3,000.

Typical, too, are mixtures of different flow improvers.

Conductivity improvers (c) for the middle distillates are generally hydrocarbon soluble carboxylic acids and/or sulfonic acids and/or their salts.

The base conductivity of middle distillates is about 5 to 10 ps/m, measured according to DIN 51 412. Fluctuations occur by different amounts of water, salts, naphthenic acids, phenols, and other sulfur and nitrogen containing compounds.

Increasing the conductivity by a factor of from 2 to 3, based on the base conductivity, is sometimes advantageous for the dispersing behavior of the paraffin dispersants described.

Adding conductivity improvers as described in, for example, DE-OS 21 16 556 generates an improvement in the response behavior even in amounts of from 0.3 to 1 ppm in the middle distillate. Other less effective conductivity improvers require, of course, a higher concentration. Adding clearly greater amounts than claimed is indeed possible, however, offers no substantial technical advantage.

Other individual examples are metal salts of hydrocarbon soluble carboxylic acids and sulfonic acids such as the commercial designation ASA3/Shell, as well as other conventional conductivity improvers, for example, commercially available Stadis 450 from DuPont, whose composition is unknown.

The special effect of the aforesaid combination a+b+c is surprising and can not be determined from the properties of the components.

The present invention is more closely illustrated by the following examples.

EXAMPLES

A) Preparation of the nitriloacetic acid amides:

1) 240 g (0.48 moles) of ditallow fatty amine and 35 g (0.12 moles) of ethylene diamine tetraacetic acid were melted and heated to 190° C., whereby the water of reaction resulting was continuously distilled off. The reaction was terminated after about 25 hours, at an acid number less than 5, and at an amine number less than 1.1. By applying a water jet vacuum (2 hours at 120° C.), the water of reaction was completely removed. Obtained was 265 g of a brown, wax like solid (=paraffin dispersing agent PD (D) in the tables).

2) 100 g (0.2 moles) of ditallow fatty amine and 14.6 g (0.05 moles) of ethylene diamine tetra-acetic acid were heated 8 hours to 180° C. After this time about 50 percent of the amine reacted into amide (acid number 45.8; theoretical 49.7). Obtained was 97.6 g of the amide/ammonium salt as a light brown, wax like solid.

3) At 80° C., 28.65 g (0.15 moles) of nitrilotriacetic acid (Trilon A) was added to the melt of 229.5 g (0.45 moles) of ditallow fatty amine. Subsequently, the reaction mixture was heated 10 hours from 180° to 190° C. The product was dried 2 hours at 120° C. using a water jet vacuum to completely remove the water of the reaction. Obtained was 249 g (theoretical 250 g) of light brown, wax like solid (=paraffin dispersing agent PD (H) in the tables).

B) Petroleum middle distillate compositions, comprising:

a) nitrilotriacetic acid amides according to A);

b) as flow improvers:

FI (A) ethylene/vinyl propionate (with about 40 weight percent vinyl propionate) having an average molecular weight of about 2,500 (vapor pressure osmometry).

FI (B) ethylene/vinyl acetate (with about 30 weight percent of vinyl acetate) having an average molecular weight of about 2,500.

FI (C) ethylene/ethylhexyl acrylate (with about 50 weight percent of ethylhexyl acrylate) having an average molecular weight of about 2,500.

c) As conductivity improvers:

LV (E) (Kerostat 5009) according to Example 1 of DE 21 16 556.

LV (F) (ASA 3/Shell) a hydrocarbon soluble sulfocarboxylic acid salt.

LV (G) (Stadis 450/DuPont) a conductivity improver of unknown composition.

Heating oil EL and diesel fuel having a commercially available Federal Republic of Germany refinery quality were used as middle distillates in the following experiments. They are designated as middle distillates A, B, and C, whereby DK is the diesel fuel and whereby HEL is heating oil EL.

| | Middle Distillate | | |
|---|---|---|---|
| | DK 1 (A) | DK 2 (B) | HEL (C) |
| Cloud Point (°C.) | −7° C. | −7° C. | +4° C. |
| CFPP (°C.) | −10° C. | −13° C. | −1° C. |
| Density at 20° C. (g/ml) | 0.817 | 0.827 | 0.826 |
| Boiling begins (°C.) | 156 | 165 | 171 |
| 20% Boiling Point (°C.) | 204 | 210 | 218 |
| 90% Boiling Point (°C.) | 309 | 318 | 344 |
| Boiling Ends (°C.) | 350 | 358 | 369 |

DESCRIPTION OF THE TEST METHODS

The middle distillates were tested with different quantities of flow improvers alone and or together with paraffin dispersing agents in combination with conductivity improvers at temperatures below the cloud point. Cooling was done with the help of a temperature program. Middle distillate A, and B (diesel fuels, Tables I, II) were cooled at room temperature to −12° C. at a cooling rate of 1° C. per hour, and stored at −12° C. for 24 hours. Middle distillate C (heating oil, Table III) was also cooled from about 20° C. to −4° C. at 1° C. per hour and also stored at −4° C. for 24 hours. The experiments were done with 100 ml and 1,000 ml of middle distillate. Tables I–III show: the volume of the sedimentated paraffin phase in percent (optically evaluated); the cloud point (CP) and the cold filter plugging point (CFPP) near the bottom (below 40 vol. percent); CP and CFPP in the upper region (above 60 vol. percent) as well as the CP and CFPP of the middle distillate containing the additives before the storage test.

As the tables show, the sedimentation of the paraffins is further reduced by adding conductivity improving additives.

| | |
|---|---|
| Table I: | Middle distillate A |
| Table II: | Middle distillate B |
| Table III: | Middle distillate C |
| Table IV–VI: | Middle distillate A. |

The following abbreviations are found in the tables:

| | | |
|---|---|---|
| T | = | Cloudy |
| K | = | Clear |
| LD | = | Easily dispersing |
| D | = | Dispersing |
| FI | = | Middle distillate flow improver (b) |
| PD | = | Paraffin dispersing agent (a) |
| LV | = | Conductivity improver (c) |

TABLE I

Middle Distillate A
CP −7° C./CFPP −10° C.

| FI (b) | | PD (a) | | LV | | Before Storage | | Paraffin- | | Lower Phase | | Upper Phase | |
|---|---|---|---|---|---|---|---|---|---|---|---|---|---|
| Type | Conc. (ppm) | Type | Conc. (ppm) | Type | Conc. (ppm) | CP (°C.) | CFPP (°C.) | Sediment (Vol. %) | Paraffin/ Oil phase | CP (°C.) | CFPP (°C.) | CP (°C.) | CFPP (°C.) |
| FI.(A) | 150 | — | — | — | — | −8 | −14 | 5 | T | −4 | −12 | −12 | −14 |
| FI.(A) | 300 | — | — | — | — | −8 | −18 | 12 | T | −4 | −12 | −11 | −17 |
| FI.(A) | 600 | — | — | — | — | −8 | −18 | 28 | K | −5 | −10 | −12 | −17 |
| FI.(A) | — | PD.(D) | 150 | — | — | −7 | −9 | 3 | T | −2 | −4 | −12 | −15 |
| FI.(A) | — | PD.(D) | 300 | — | — | −7 | −9 | 2 | T | −2 | −5 | −12 | −15 |
| FI.(A) | — | PD.(D) | 500 | — | — | −8 | −10 | 3 | LD | −4 | −7 | −11 | |
| FI.(A) | — | — | — | LV.(E) | 1 | −8 | −9 | 37 | K | −1 | −5 | −12 | |
| FI.(A) | — | — | — | LV.(E) | 5 | −7 | −9 | 39 | K | −2 | −5 | −12 | −16 |
| FI.(A) | 150 | PD.(D) | 150 | — | — | −8 | −15 | 2 | D | −4 | −12 | −10 | −20 |
| FI.(A) | 150 | PD.(D) | 150 | LV.(E) | 1 | −7 | −20 | 0 | D | −7 | −20 | −8 | −20 |
| FI.(A) | 150 | PD.(D) | 150 | LV.(E) | 5 | −8 | −19 | 0 | D | −7 | −20 | −9 | −20 |
| FI.(A) | 300 | PD.(D) | 300 | — | — | −8 | −29 | 23 | LD | −4 | −21 | −10 | −32 |
| FI.(A) | 300 | PD.(D) | 300 | LV.(E) | 1 | −7 | −29 | 0 | D | −7 | −29 | −8 | −30 |
| FI.(A) | 300 | PD.(D) | 300 | LV.(E) | 5 | −8 | −30 | 0 | D | −7 | −30 | −8 | −31 |
| FI.(A) | 300 | PD.(D) | 500 | — | — | −7 | −26 | 5 | LD | −5 | −22 | −10 | −30 |
| FI.(A) | 300 | PD.(D) | 500 | LV.(E) | 1 | −8 | −28 | 3 | D | −7 | −24 | −8 | −29 |
| FI.(A) | 300 | PD.(D) | 500 | LV.(E) | 5 | −8 | −29 | 0 | D | −8 | −27 | −9 | −29 |

TABLE II

| Middle Distillate B CP −7° C./CFPP −13° C. | | | | | | | | | | | | | |
|---|---|---|---|---|---|---|---|---|---|---|---|---|---|
| FI (b) | | PD (a) | | LV | | Before Storage | | Paraffin- | | Lower Phase | | Upper Phase | |
| Type | Conc. (ppm) | Type | Conc. (ppm) | Type | Conc. (ppm) | CP (°C.) | CFPP (°C.) | Sediment (Vol. %) | Paraffin/ Oil phase | CP (°C.) | CFPP (°C.) | CP (°C.) | CFPP (°C.) |
| FI.(A) | 150 | — | — | — | — | −7 | −13 | 13 | T | −4 | −8 | −11 | −15 |
| FI.(A) | 300 | — | — | — | — | −7 | −13 | 18 | T | −4 | −9 | −11 | −15 |
| FI.(A) | 600 | — | — | — | — | −8 | −22 | 20 | T | −5 | −12 | −11 | −22 |
| — | — | PD.(D) | 150 | — | — | −8 | −13 | 83 D | T | −5 | −12 | −8 | −14 |
| — | — | PD.(D) | 300 | — | — | −8 | −15 | 87 D | T | −5 | −13 | −8 | −16 |
| — | — | PD.(D) | 500 | — | — | −8 | −15 | 87 D | T | −6 | −12 | −9 | −20 |
| — | — | — | — | LV.(E) | 1 | −7 | −12 | 18 | LD | −4 | −12 | −11 | −14 |
| — | — | — | — | LV.(E) | 5 | −8 | −13 | 20 | LD | −6 | −13 | −10 | −14 |
| FI.(A) | 150 | PD.(D) | 150 | — | — | −8 | −14 | 12 | LD | −4 | −9 | −8 | |
| FI.(A) | 150 | PD.(D) | 150 | LV.(E) | 1 | −8 | −14 | 5 | D | −6 | −12 | −8 | −14 |
| FI.(A) | 150 | PD.(D) | 150 | LV.(E) | 5 | −8 | −15 | 2 | D | −8 | −12 | −9 | −16 |
| FI.(A) | 300 | PD.(D) | 300 | — | — | −7 | −21 | 10 | D | −5 | −12 | −9 | −28 |
| FI.(A) | 300 | PD.(D) | 300 | LV.(E) | 1 | −7 | −29 | 0 | D | −7 | −15 | −7 | −31 |
| FI.(A) | 300 | PD.(D) | 300 | LV.(E) | 5 | −8 | −28 | 0 | D | −8 | −26 | −9 | −29 |
| FI.(A) | 300 | PD.(D) | 500 | — | — | −8 | −28 | 0 | D | −7 | −19 | −8 | −30 |
| FI.(A) | 300 | PD.(D) | 500 | LV.(E) | 1 | −8 | −29 | 0 | D | −8 | −27 | −8 | −29 |
| FI.(A) | 300 | PD.(D) | 500 | LV.(E) | 5 | −8 | −28 | 0 | D | −8 | −28 | −9 | −30 |

TABLE III

| Middle Distillate B CP +4° C./CFPP −1° C. | | | | | | | | | | | | | |
|---|---|---|---|---|---|---|---|---|---|---|---|---|---|
| FI (b) | | PD (a) | | LV | | Before Storage | | Paraffin- | | Lower Phase | | Upper Phase | |
| Type | Conc. (ppm) | Type | Conc. (ppm) | Type | Conc. (ppm) | CP (°C.) | CFPP (°C.) | Sediment (Vol. %) | Paraffin/ Oil phase | CP (°C.) | CFPP (°C.) | CP (°C.) | CFPP (°C.) |
| FI.(A) | 150 | — | — | — | — | +4 | −8 | 13 | T | +10 | +2 | −3 | −6 |
| FI.(A) | 300 | — | — | — | — | +3 | −10 | 20 | T | +10 | −4 | −2 | −10 |
| FI.(A) | 600 | — | — | — | — | +4 | −14 | 22 | T | +9 | −7 | −4 | −6 |
| — | — | PD.(D) | 150 | — | — | +3 | −1 | 90 | K | +7 | +3 | +3 | −2 |
| — | — | PD.(D) | 300 | — | — | +4 | ±0 | 90 | K | +8 | +2 | +3 | −4 |
| — | — | PD.(D) | 500 | — | — | +3 | −1 | 48 | K | +6 | +7 | −4 | −8 |
| — | — | — | — | LV.(E) | 1 | +4 | ±0 | 80 | K | +6 | +4 | +3 | −4 |
| — | — | — | — | LV.(E) | 5 | +4 | ±0 | 90 | K | +6 | +2 | +3 | |
| FI.(A) | 150 | PD.(D) | 150 | — | — | +4 | −9 | 13 | T | +11 | ±0 | −2 | |
| FI.(A) | 150 | PD.(D) | 150 | LV.(E) | 1 | +3 | −10 | 5 | LD | +10 | +1 | −1 | |
| FI.(A) | 150 | PD.(D) | 150 | LV.(E) | 5 | +4 | −10 | 5 | LD | +9 | +4 | −3 | −8 |
| FI.(A) | 300 | PD.(D) | 300 | — | — | +4 | −10 | 18 | T | +10 | −6 | −2 | −9 |
| FI.(A) | 300 | PD.(D) | 300 | LV.(E) | 1 | +4 | −9 | 39 | D | +8 | −7 | +1 | −14 |
| FI.(A) | 300 | PD.(D) | 300 | LV.(E) | 5 | +4 | −8 | 2 | D | +5 | −11 | +3 | −11 |
| FI.(A) | 300 | PD.(D) | 500 | — | — | +4 | −11 | 20 | T | +8 | −7 | −1 | −8 |
| FI.(A) | 300 | PD.(D) | 500 | LV.(E) | 1 | +4 | −11 | 15 | D | +9 | −8 | +1 | −16 |
| FI.(A) | 300 | PD.(D) | 500 | LV.(E) | 5 | +4 | −10 | 0 | D | +5 | −11 | +2 | −15 |

TABLE IV

| Middle Distillate A CP −7° C./CFPP −10° C. | | | | | | | | | | | | | |
|---|---|---|---|---|---|---|---|---|---|---|---|---|---|
| FI (b) | | PD (a) | | LV | | Before Storage | | Paraffin- | | Lower Phase | | Upper Phase | |
| Type | Conc. (ppm) | Type | Conc. (ppm) | Type | Conc. (ppm) | CP (°C.) | CFPP (°C.) | Sediment (Vol. %) | Paraffin/ Oil phase | CP (°C.) | CFPP (°C.) | CP (°C.) | CFPP (°C.) |
| FI.(B) | 300 | — | — | — | — | −8 | −28 | 10 | LD | −2 | −21 | −11 | −15 |
| FI.(B) | 300 | PD.(D) | 500 | — | — | −8 | −29 | 8 | LD | −4 | −27 | −10 | −33 |
| FI.(B) | 300 | — | — | LV.(E) | 2 | −7 | −27 | 10 | LD | −3 | −26 | −10 | −29 |
| FI.(B) | 300 | PD.(D) | 500 | LV.(E) | 2 | −8 | −32 | 0 | D | −7 | −30 | −7 | −28 |
| FI.(C) | 300 | — | — | — | — | −7 | −26 | 2 | LD | −2 | −24 | −11 | −31 |
| FI.(C) | 300 | PD.(D) | 500 | — | — | −7 | −26 | 0 | D | −7 | −24 | −7 | −31 |
| FI.(C) | 300 | — | — | LV.(E) | 2 | −7 | −25 | 8 | LD | −10 | −20 | −3 | −29 |
| FI.(C) | 300 | PD.(D) | 500 | LV.(E) | 2 | −8 | −25 | 0 | D | −7 | −23 | −7 | |

TABLE V

| Middle Distillate A CP −7° C./CFPP −10° C. | | | | | | | | | | | | | |
|---|---|---|---|---|---|---|---|---|---|---|---|---|---|
| FI (b) | | PD (a) | | LV | | Before Storage | | Paraffin- | | Lower Phase | | Upper Phase | |
| Type | Conc. (ppm) | Type | Conc. (ppm) | Type | Conc. (ppm) | CP (°C.) | CFPP (°C.) | Sediment (Vol. %) | Paraffin/ Oil phase | CP (°C.) | CFPP (°C.) | CP (°C.) | CFPP (°C.) |
| FI.(A) | 300 | — | — | — | — | −8 | −18 | 12 | T | −4 | −12 | −11 | −17 |
| FI.(A) | 300 | PD.(D) | 500 | — | — | −8 | −25 | 0 | D | −7 | −23 | −8 | −31 |
| FI.(A) | 300 | PD.(D) | 500 | LV.(E) | 1 | −7 | −24 | 0 | D | −7 | −25 | −8 | −26 |

TABLE V-continued

| FI (b) | | PD (a) | | LV | | Middle Distillate A CP −7° C./CFPP −10° C. Before Storage | | Paraffin- | | Lower Phase | | Upper Phase | |
|---|---|---|---|---|---|---|---|---|---|---|---|---|---|
| Type | Conc. (ppm) | Type | Conc. (ppm) | Type | Conc. (ppm) | CP (°C.) | CFPP (°C.) | Sediment (Vol. %) | Paraffin/ Oil phase | CP (°C.) | CFPP (°C.) | CP (°C.) | CFPP (°C.) |
| FI.(A) | 300 | PD.(D) | 500 | LV.(E) | 5 | −8 | −26 | 0 | D | −7 | −26 | −8 | −28 |

TABLE VI

| FI (b) | | PD (a) | | LV | | Middle Distillate A CP −7° C./CFPP −10° C. Before Storage | | Paraffin- | | Lower Phase | | Upper Phase | |
|---|---|---|---|---|---|---|---|---|---|---|---|---|---|
| Type | Conc. (ppm) | Type | Conc. (ppm) | Type | Conc. (ppm) | CP (°C.) | CFPP (°C.) | Sediment (Vol. %) | Paraffin/ Oil phase | CP (°C.) | CFPP (°C.) | CP (°C.) | CFPP (°C.) |
| FI.(A) | 300 | — | — | LV.(F) | 1 | −8 | −18 | 12 | T | −3 | −20 | −12 | −16 |
| FI.(A) | 300 | — | — | LV.(F) | 5 | −7 | −19 | 12 | T | −3 | −20 | −11 | −18 |
| FI.(A) | 300 | PD.(D) | 500 | LV.(F) | 5 | −8 | −26 | 0 | D | −7 | −28 | −7 | −29 |
| FI.(A) | 300 | — | — | LV.(G) | 3 | −8 | −19 | 18 | T | −3 | −12 | −11 | −17 |
| FI.(A) | 300 | — | — | LV.(G) | 15 | −8 | −18 | 15 | T | −3 | −17 | −11 | −21 |
| FI.(A) | 300 | PD.(D) | 500 | LV.(G) | 15 | −7 | −30 | 0 | D | −7 | −27 | −7 | −33 |

We claim:

1. Middle distillate compositions comprising a hydrocarbon mixture boiling between 160° and 420° C. and a minor amount of amides, amide ammonium salts, ammonium salts and their mixtures of aminoalkylene polycarboxylic acids having general structural formula I or II;

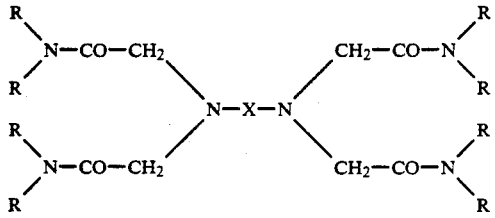

I

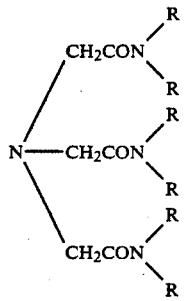

II whereby X is a straight chain or branched alkylene radical having 2 to 6 carbon atoms or the following radical

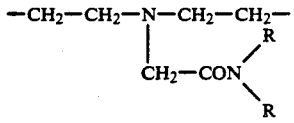

in which R, independent from one another, are straight chain aliphatic radicals having 10 to 30 carbon atoms, whereby the amide groups can also be present as alkyl ammonium carboxylate groups with aforesaid radicals R.

2. Middle distillate compositions comprising a hydrocarbon mixture boiling between 160° and 420° C. and a minor amount of amides, amide ammonium salts, ammonium salts and their mixtures of aminoalkylene polycarboxylic acids having general structural formula I or II;

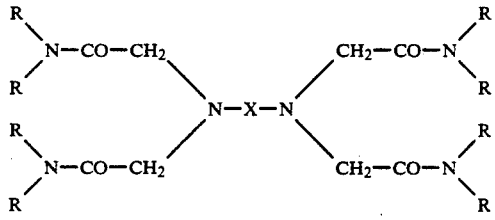

I

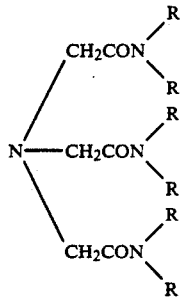

II whereby X is a straight chain or branched alkylene radical having 2 to 6 carbon atoms or the following radical

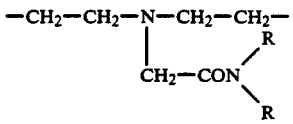

in which R, independent from one another, are straight chain aliphatic radicals having 10 to 30 carbon atoms, whereby the amide groups can also be present as alkyl ammonium carboxylate groups with aforesaid radicals R; and conventional ethylene copolymer middle distillate flow improvers.

3. Middle distillate compositions comprising a hydrocarbon mixture boiling between 160° and 420° C. and a minor amount of amides, amide ammonium salts, ammonium salts and their mixtures of aminoalkylene polycarboxylic acids having general structural formula I or II;

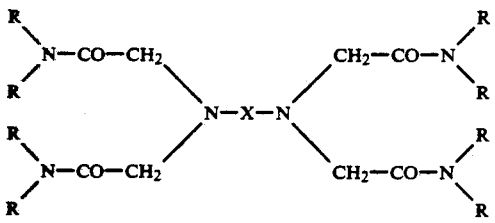

I

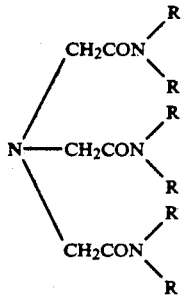

II whereby X is a straight chain or branched alkylene radical having 2 to 6 carbon atoms or the following radical

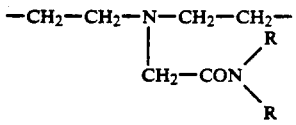

in which R, independent from one another, are straight chain aliphatic radicals having 10 to 30 carbon atoms, whereby the amide groups can also be present as alkyl ammonium carboxylate groups with aforesaid radicals R; and conventional ethylene copolymer middle distillate flow improvers and hydrocarbon conductivity improvers selected from the group consisting of hydrocarbon soluble carboxylic acids, sulfonic acids and their metal and ammonium salts.

4. Middle distillate compositions comprising a hydrocarbon mixture boiling between 160° and 420° C. and 50 to 1000 ppm, based on said compositions, of amides, amide ammonium salts, ammonium salts and their mixtures of aminoalkylene polycarboxylic acids having general structural formula I or II;

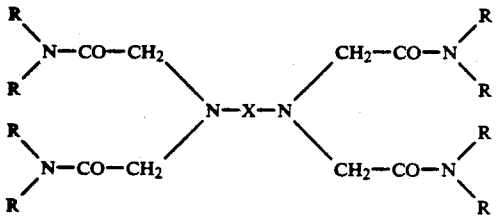

I

-continued

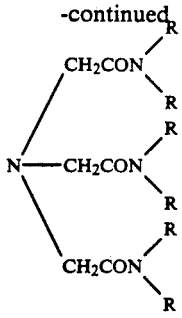

II whereby X is a straight chain or branched alkylene radical having 2 to 6 carbon atoms or the following radical

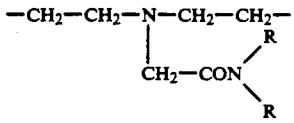

in which R, independent from one another, are straight chain aliphatic radicals having 10 to 30 carbon atoms, whereby the amide groups can also be present as alkyl ammonium carboxylate groups with aforesaid radicals R; and 50 to 1000 ppm, based on said compositions, of conventional ethylene copolymer middle distillate flow improvers.

5. Middle distillate compositions comprising a hydrocarbon mixture boiling between 160° and 420° C. and 100 to 500 ppm, based on said compositions, of amides, amide ammonium salts, ammonium salts and their mixtures of aminoalkylene polycarboxylic acids having general structural formula I or II;

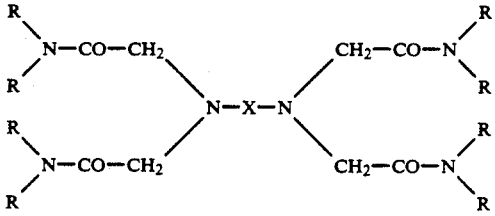

I

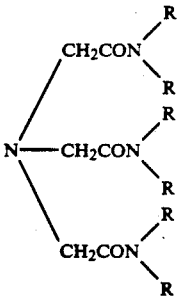

II whereby X is a straight chain or branched alkylene radical having 2 to 6 carbon atoms or the following radical

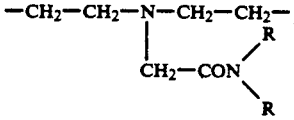

in which R, independent from one another, are straight chain aliphatic radicals having 10 to 30 carbon atoms, whereby the amide groups can also be present as alkyl ammonium carboxylate groups with aforesaid radicals R; and 50 to 500 ppm, based on said compositions, of conventional ethylene copolymer middle distillate flow improvers and from 0.25 to 40 ppm, based on said compositions, of hydrocarbon conductivity improvers selected from the group consisting of hydrocarbon soluble carboxylic acids, sulfonic acids and their metal and ammonium salts.

* * * * *